US006196931B1

(12) United States Patent
Wilt

(10) Patent No.: US 6,196,931 B1
(45) Date of Patent: Mar. 6, 2001

(54) APPARATUS FOR DEVELOPING GOLF SWING

(76) Inventor: David B. Wilt, 1602 E. Market St., Akron, OH (US) 44305

( * ) Notice: Subject to any disclaimer, the term of this patent is extended or adjusted under 35 U.S.C. 154(b) by 0 days.

(21) Appl. No.: 09/397,232

(22) Filed: Sep. 16, 1999

Related U.S. Application Data

(63) Continuation of application No. 09/251,622, filed on Feb. 17, 1999, now abandoned.

(51) Int. Cl.[7] ..... A63B 69/36
(52) U.S. Cl. ..... 473/212; 473/207
(58) Field of Search ..... 473/212–215, 473/63, 276, 266, 450; 273/DIG. 19, 21, 30

(56) References Cited

U.S. PATENT DOCUMENTS

| | | | | |
|---|---|---|---|---|
| 2,773,691 | | 12/1956 | Redfield . | |
| 3,069,169 | * | 12/1962 | Topping | 473/212 |
| 5,188,365 | | 2/1993 | Picard . | |
| 5,295,690 | * | 3/1994 | Johnson | 473/212 |
| 5,665,015 | * | 9/1997 | Clark, III | 473/215 |
| 5,718,640 | | 2/1998 | Noblin . | |
| 6,027,413 | * | 10/1998 | Smith et al. | 473/212 |

* cited by examiner

*Primary Examiner*—Stephen F. Gerrity
*Assistant Examiner*—Mitra Aryanpour
(74) *Attorney, Agent, or Firm*—Oldham & Oldham Co., L.P.A.

(57) ABSTRACT

An apparatus for developing a consistent and working golf swing in the classic form, by constraining the movement of the wearer's trail arm in relation to the wearer's torso from the set-up, through striking of the ball, while allowing for unrestricted movement for the swing follow through. The apparatus comprises a resilient arm band formed in an arm loop that is partially self adjusting, being worn by a golfer on the trailing arm just above the elbow. The arm band connects to an adjustable strap assembly which comprises an inelastic strap which adjustably loops through a manually adjustable strap buckle. The adjustable strap assembly connects to a belt line anchor through an "O"-ring connector. The belt line anchor is attached to the wearer's waist or belt at a point on the waist or belt, above the hip of the wearer on the wearer's pants or belt, opposite the trailing arm. The adjustable strap assembly further comprises a snap together connector that allows the apparatus to be easily disconnected into two parts. The apparatus is adjustable and is thus intended to work with all body sizes and to promote a workable and consistent swing plane and path that allows the wearer to discover the feel of a working golf swing in the classic form.

17 Claims, 5 Drawing Sheets

APPARATUS FOR DEVELOPING GOLF SWING

This Application is a Continuation of Ser. No. 09/251,622 filed Feb. 17, 1999, now abandoned.

The present invention relates generally to an apparatus for developing a golf swing. More particularly, this invention relates to an apparatus for developing a working golf swing in the classic style, by restraining the wearer's trail arm in a manner restricting movement out and away from the torso and keeping it in front of the body throughout the different stages of a golf swing while allowing unrestricted movement for the swing follow through.

BACKGROUND OF THE ART

Golf is a highly popular worldwide source of exercise and recreation for persons of all ages and levels of skill. Anyone who has attempted to hit a golf ball realizes that it is not an easy endeavor. To become proficient in the game it is necessary for the golfer to develop a precision swing so that he or she can accurately strike the ball with the golf club in order to propel the ball in the desired line of flight toward the hole. While practicing, typical weekend golfers do not hit many of the balls properly and usually hit most of the balls in the bucket in attempting to determine why he/she is not hitting the balls properly. For example, the golfer may try to concentrate on watching the ball, making sure to turn the shoulders and hips, making sure not to have a "reverse weight shift", trying not to "hit from the top", trying to watch out for that "flying elbow". By the time the golfer figures out what the proper swing should be, he or she is either out of time or out of practice balls. Thus, the golfer has not only wasted the practice time, but the balls hit were hit wrong which has engraved negative swing mechanics.

Inventions have been developed over the years for the purpose of assisting a golfer to develop a precision swing. U.S. Pat. Nos. 5,718,640 and 5,188,365 disclose examples of one type of such invention which generally are harnesses or limb guiding means intended to assist a golfer in developing a precision golf swing. Often these known devices are too complex and try to control all aspects of the body at once. The device disclosed in U.S. Pat. No. 5,188,365 restrains the golfer at the leading knee, leading wrist, trailing elbow and waist. One problem with this device such as shown in U.S. Pat. No. 5,718,640 is that the trailing elbow is connectably restrained to the trailing side of the waist which prevents proper follow through of the golf swing. Another device disclosed in U.S. Pat. No. 2,773,691 avoids this problem by providing a harness with a diagonal guide rail or rod member which allows the trailing elbow harness to travel up and across the body. This rod is not adjustable to different angles which may be required for different users of varying body heights and builds. While this device is superior to the others in that it allows a follow through to the swing, the follow through may not be part of a precision swing due to drag of the connecting ring traveling up the rod and the fact that the rod may be at an improper angle. The rod may also interfere with the movement of the trailing arm during follow through.

Accordingly, a need exists to provide a simple and effective apparatus for developing a golf swing which eliminates many of the swing problems which occur during a full golf swing.

SUMMARY OF THE INVENTION

The present invention is designed to train a golfer to develop a classic and repeatable golf swing. The apparatus for developing a golf swing is worn by a golfer on his trailing arm and connected to his belt or pants above the hip opposite the trailing arm. The apparatus generally comprises an arm band, a partially self-adjusting buckle, a manual adjustment strap assembly and a belt line anchor. The first end of the arm band is connected to the partially self-adjusting buckle through which the second end and the intermediate portion of the arm band is pulled to form an arm loop whose diameter can be adjusted to automatically fit the arm of a user by pulling on the second end. The second end of the arm band is attached to the adjustment strap assembly which comprises at least one inelastic strap and a manually adjustable buckle or Velcro strip to shorten or lengthen the strap assembly. The belt line anchor comprises a means for securing the device to either the waist belt of the wearer or the waist of the wearer's pants or shorts. Both the adjustment strap assembly and the belt line anchor are slidably connected by a connector means such as a metallic "O" ring. The apparatus is adjustable and works with all body sizes and builds to promote a consistent swing path and plane by keeping the trail arm in a proper position throughout the swing. The proper positioning of the trail arm in turn promotes the proper positioning of the upper torso, head, shoulders and arms throughout the swing. The apparatus allows the wearer to discover the feel of a working, classic golf swing. The repeated use of the apparatus will train the wearer to repeat the swing and make a solid hit on the golf ball time after time, even when not wearing the apparatus.

BRIEF DESCRIPTION OF THE DRAWINGS

Better understanding of the present invention will be had when reference is made to the accompanying drawings, wherein identical parts are identified with identical reference numerals, and wherein.

DETAILED DESCRIPTION OF THE DRAWINGS

Figure 1:
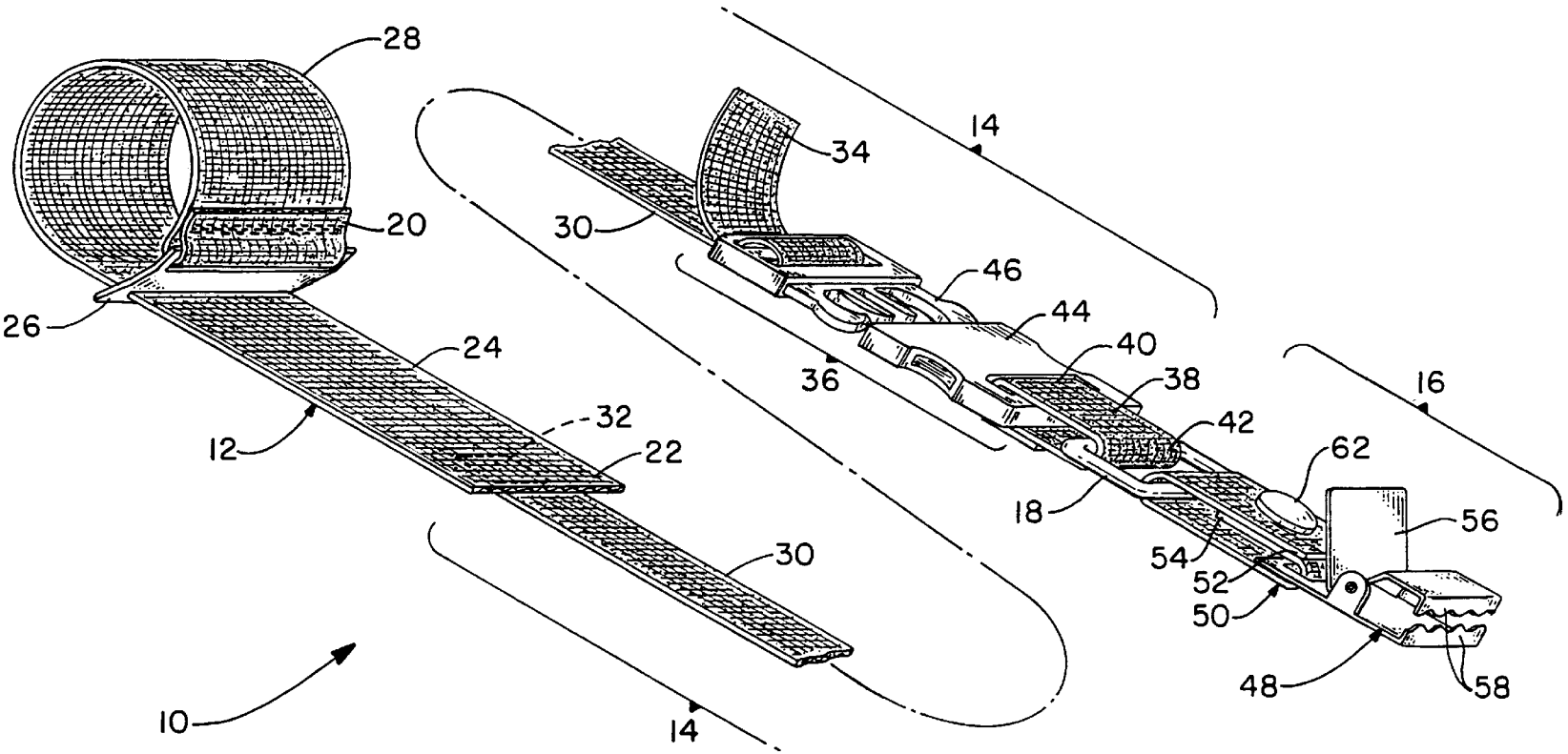
FIG. 1 shows a perspective view of the preferred embodiment of the apparatus for developing a golf swing.

The preferred embodiment of the present invention is depicted in FIG. 1, wherein the apparatus for developing a golf swing 10 comprises a resilient arm band 12, an inelastic adjustable strap assembly 14, a waist belt line anchor 16 and a connector means 18. The arm band 12 is preferably made of a single piece of an elastic material. The arm band 12 has a first end 20, a second end 22, and an intermediate portion 24 therebetween. The first end 20 is attached to a partially self-adjusting buckle 26 using a suitable known attachment means such as sewing, staples, etc. The partially self-adjusting buckle 26 is preferably made of a metallic or plastic material. The intermediate portion 24 of the arm band 12 is pulled through the partially self-adjusting buckle 26 forming an arm loop 28 whose diameter can be adjusted to fit the arm of a user just above the elbow by pulling on the second end 22 of the arm band 12. The second end 22 of the arm band 12 is fixably attached to a first end 32 of the adjustable strap assembly 14 using a known suitable attachment means such as sewing, rivets, staples, etc. in an overlapping manner that resists twisting of the apparatus when in use. The adjustable strap assembly 14 of the preferred embodiment comprises a first inelastic strap 30 having a first end 32 and a second end 34, a manual adjustment buckle and snap-together clip 36 of a known type, a second inelastic strap 38 having a first end 40 and a second end 42. The first inelastic strap 30 and the second inelastic strap 38 are preferably made of a nylon web strap. The second end 34 of the first inelastic strap 30 is looped through the buckle portion of the buckle and snap-together clip 36 in a manner allowing the length of the adjustable strap assembly 14 to be lengthened or shortened to meet the requirements of the individual wearer. The buckle and snap-together clip 36 comprises a female snap and buckle portion 44 which is detachable from the male snap and adjustable buckle portion 46. The first end 40 of the second inelastic strap 38 is looped around the buckle of the female snap and buckle portion 44 and attached to itself using a known attachment means such as sewing, staples, etc. The buckle and snap-together clip 36 allows the user to adjust the length of the adjustable strap assembly 14 while wearing the apparatus. The second end 42 of the second inelastic strap 38 is looped around the connector means 18 and attached to itself using a known attachment means such as sewing, staples, etc. The connector means 18 is preferably a metallic "O" ring connector which will allow slight rotational displacement of the adjustable strap assembly 14 and the waist belt line anchor 16 which are connected thereto, during the different stages of the golf swing. The waist belt line anchor 16 comprises a locking clip 48 and an inelastic strap 50 having a first end 52 and a second end 54. The inelastic strap 50 is preferably made of a nylon web strap. The locking clip 48 is preferably of a known heavy-duty type typically used with suspenders having a buckle portion 56 opposite a jaws clip portion 58. The locking clip 48 must be strong enough to withstand the tension of the elastic arm band 12 without letting go of the wearer's belt, pants or shorts. The inelastic strap 50 is looped around the connector means 18 and slidably attached thereto by sewing the strap together in a manner that the first end 52 of the strap extending therefrom is considerably longer than the second end 54 of the strap. A metal snap 62 is used to attach the first end 52 of the strap 50 to the second end 54 of the strap 50. The first end 52 of the strap 50 is looped around the buckle portion 56 of the locking clip 48 and attached to the second end 54 of the strap 48 using the metal snap 62.

Figure 2:
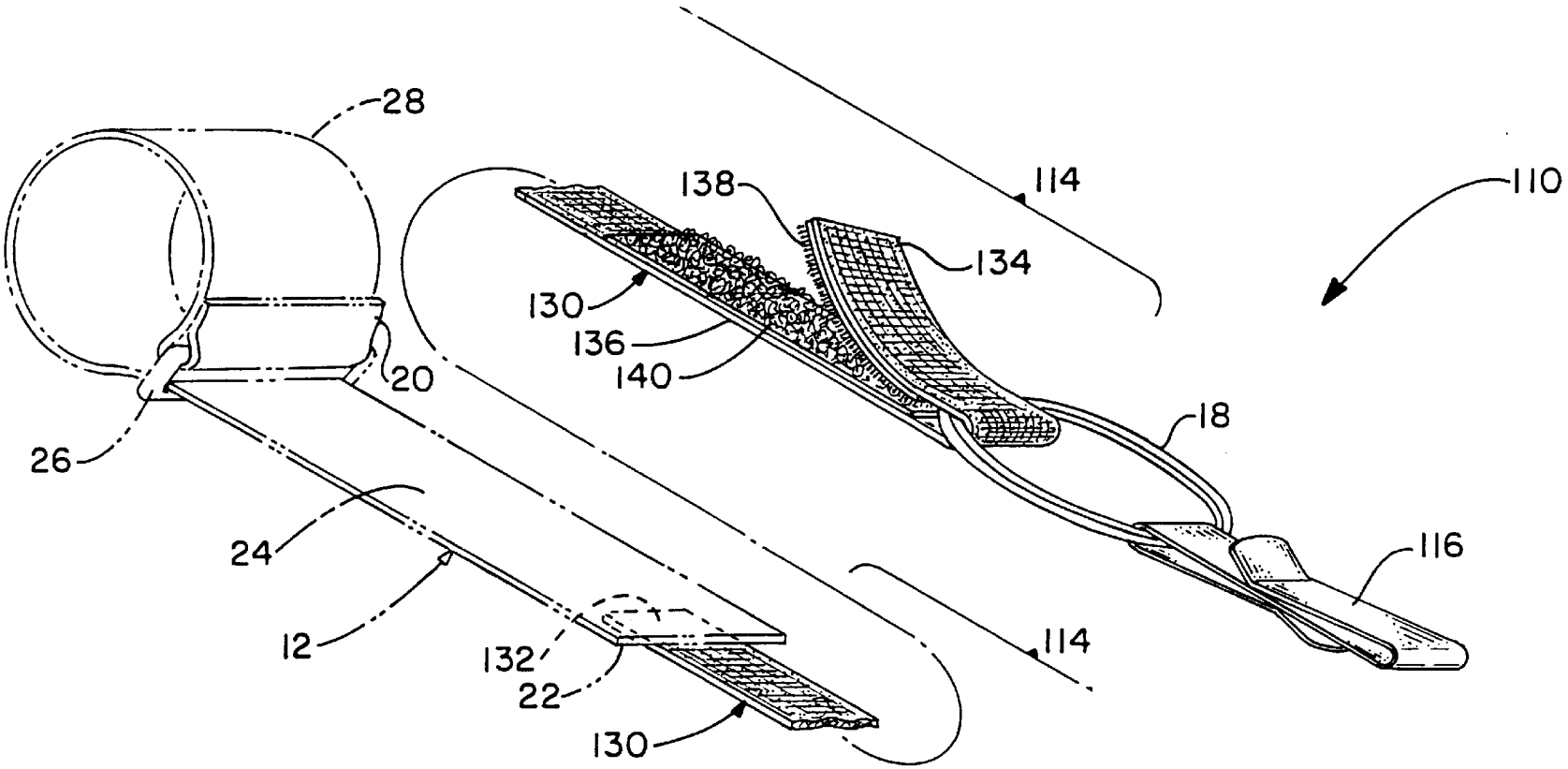
FIG. 2 shows a perspective view of an alternate embodiment of the apparatus for developing a golf swing.

An alternate embodiment is shown in FIG. 2. The apparatus for developing a golf swing 110 is depicted with arm band 12 of the first embodiment, an adjustable strap 114 assembly, a belt line anchor 116 and an "O" ring connector means 18. The adjustable strap assembly 114 comprises an inelastic strap 130 having a first end 132 and a second end 134 and an intermediate portion therebetween 136. The inelastic strap 130 is preferably made of a nylon web type material which is the same as or similar to the material used in the first embodiment. The first end 132 of the inelastic strap 130 is attached to the second end 22 of the arm band 12 using a suitable attachment means as described in the first embodiment. The second end 134 of the inelastic strap 130 is looped through the "0" ring connector means 18 and adjustably attaches to the intermediate portion of the inelastic strap 130 so that the length of the adjustable strap assembly 114 can be modified in order to adjust the tension on the arm band 12. This attachment is herein shown, but not limited to, a Velcro type connection having a male Velcro strip 138 attached to and extending inwardly from the second end 134 of the inelastic strap 130 and a female Velcro strip 140 of considerable longer length attached to the intermediate portion 136 of the inelastic strap 130 near the first end 132 and running inwardly along the intermediate portion 136 of the strap. A belt line anchor 116 comprises a single piece metallic band bent by known methods to form a "S" shaped hook. One end of the hook attaches to the "O" ring connector 18 and the other end attaches to the waist belt of the wearer. As with the first embodiment, the apparatus 110 allows the user to adjust the length of the adjustable strap assembly 114 while wearing the apparatus.

Figure 3:
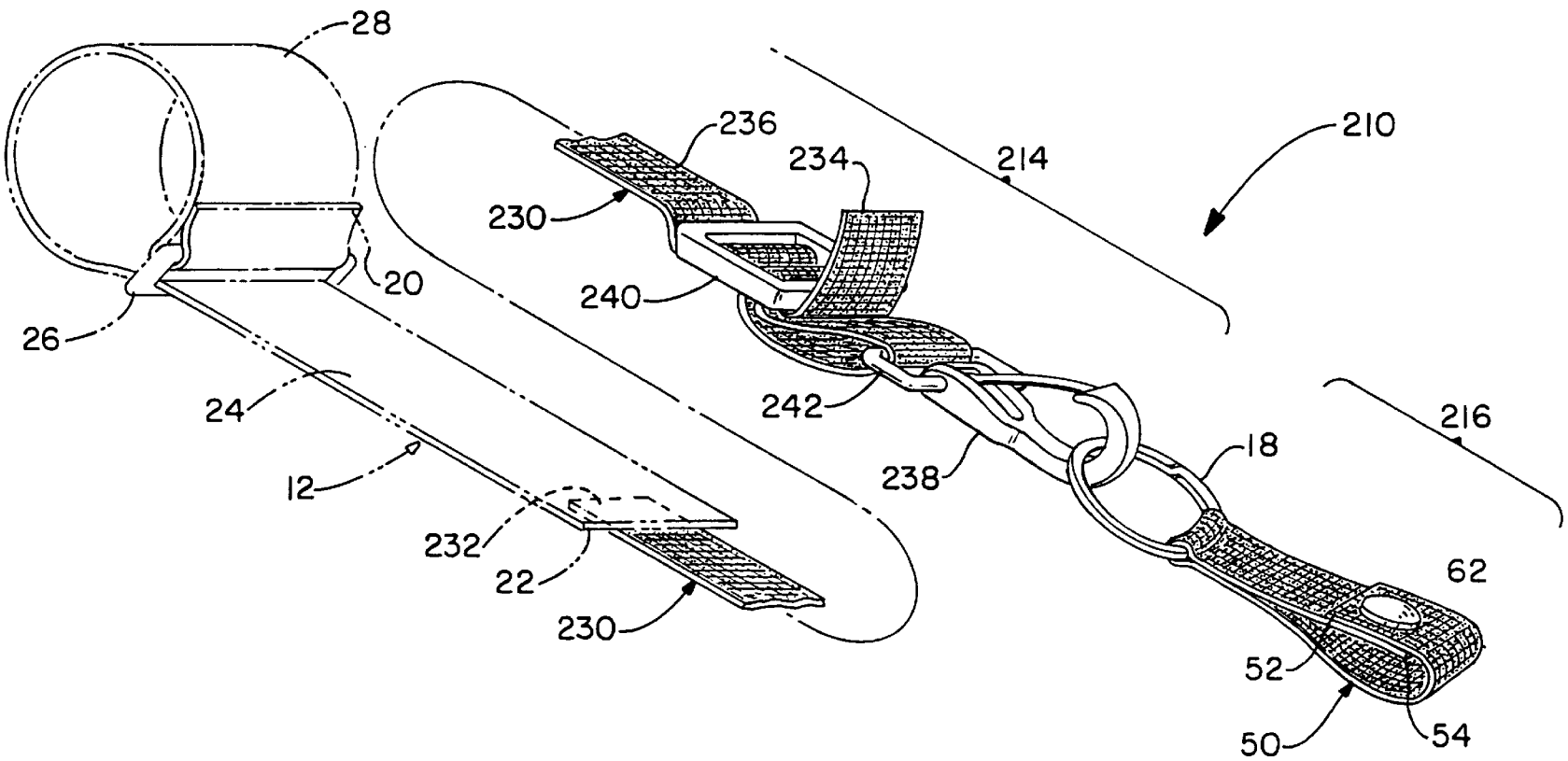
FIG. 3 shows a perspective view of another alternate embodiment of the apparatus for developing a golf swing.

Another alternate embodiment is shown in FIG. 3. The apparatus for developing a golf swing 210 is depicted comprising the arm band 12 of the first embodiment, an adjustable strap assembly 214, a belt line anchor 216 and an "O" ring connector means 18 of the first embodiment. The adjustable strap assembly 214 comprises an inelastic strap 230 having a first end 232 and a second end 234 and an intermediate portion therebetween 236 and a spring locking hooked fastener 238 of a known type. The inelastic strap 230 is preferably made of a nylon web type material which is the same as or similar to the material used in the first embodiment. The second end 22 of the arm band 12 is fixably attached to the first end 232 of the inelastic strap 230. The second end 234 of the inelastic strap 230 is looped through an adjustable strap buckle 240 and through a rectangularly shaped, buckle-like first end 242 of the spring locking hooked fastener 238. The adjustable strap buckle 240 is preferably made of a plastic material with two interior bars having parallel spaced gripping members to grip the nylon web material. The second end 234 of the inelastic strap 230 is then looped back through the adjustable strap buckle 240 in a manner allowing the length of the strap to be adjusted to different lengths. The hooked end portion of the spring locking fastener 238 clips onto the "O" ring connector means 18. The belt line anchor 216 comprises an inelastic strap 50 having a first end 52 and a second end 54 as shown in the first embodiment but herein used without the locking clip. The inelastic strap 50 is looped around the connector means 18 and slidably attached thereto by sewing the strap together in a manner that the first end 52 of the strap extending therefrom is considerably longer than the second end 54 of the strap. A metal snap is used to attach the first end 52 of the strap 50 to the second end 54 of the strap 50. The first end 52 of the strap 50 is looped underneath the wearer's belt at a point located over the hip opposite the trail arm and around to the exterior of the belt behind a belt loop in the wearer's pants where it is attached to the second end 54 using the metal snap 62. The snap is easily accessible as to be attached and detached quickly by the wearer.

Figure 4:
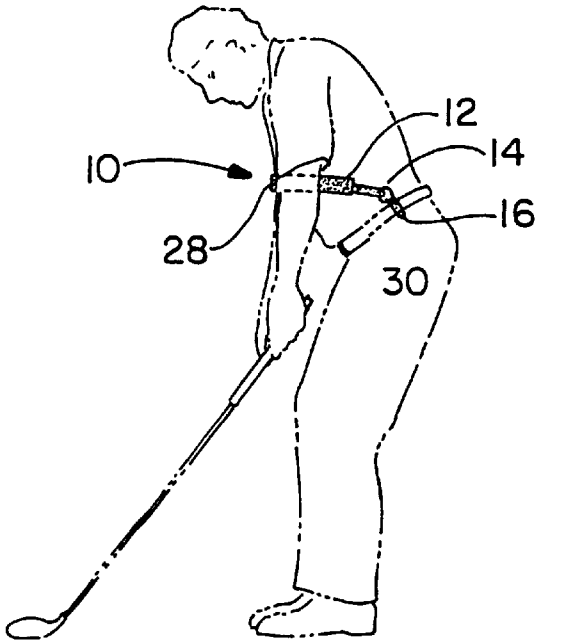
FIG. 4 shows the leading side view of the apparatus on a golfer depicting the proper location of the belt line anchor.

FIGS. 4–9 depict the apparatus of the present invention as used by the golfer. The apparatus for developing a golf swing 10 is shown in the figures as worn by a right handed golfer but is just as easily used by a left handed golfer. The arm band 12 is fitted securely around the right arm, or trail arm, just above the elbow. The apparatus 10 is stretched down and across the golfer's body and attached to the golfer's belt above his left hip as shown in FIG. 4.

Figure 5:
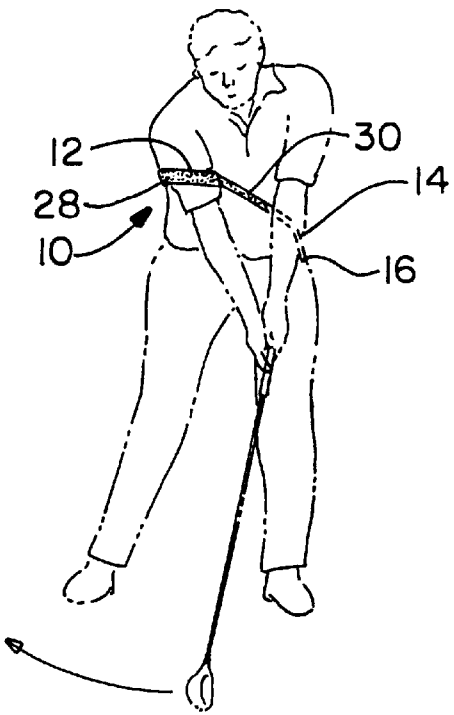
FIG. 5 shows the front view of the apparatus on a golfer in a proper set-up stance.

FIG. 5 shows that the golfer using the apparatus for developing a golf swing 10 will be able to set-up with his right arm close to and in front of his body in a proper set-up stance.

Figure 6:
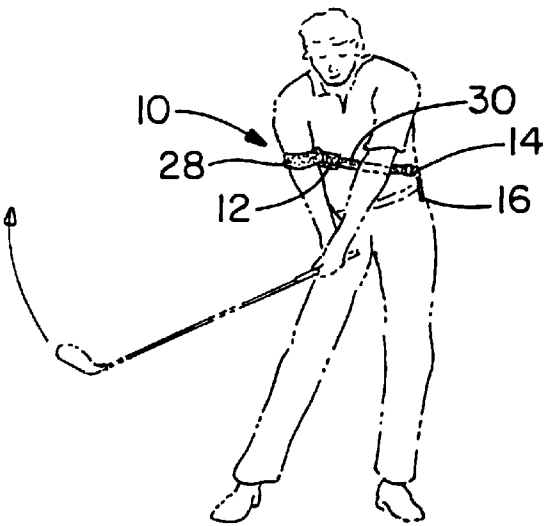
FIG. 6 shows the front view of the apparatus on a golfer at the start of a back swing.

In FIG. 6, the apparatus 10 allows the wearer to turn away from the golf ball, but restricts the wearer from taking the golf club back with his arms, thus promoting what is referred to as a "one-piece take away".

Figure 7:
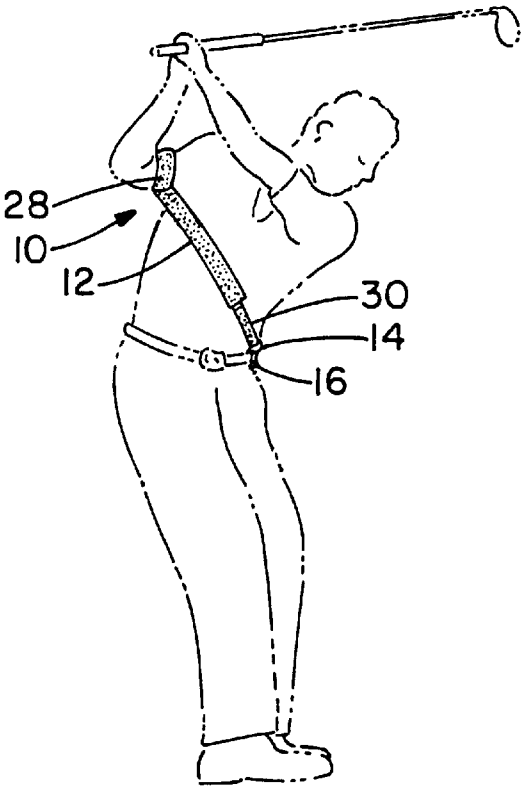
FIG. 7 shows the trailing side view of the apparatus on a golfer at the end of a back swing.

In FIG. 7, the wearer is at the top of a back swing. The apparatus 10 causes the wearer to turn his body away from the intended line of ball flight instead of pushing his hands back from the ball. This encourages a full ninety degree turn to the right of the wearer's shoulders and upper torso while the wearer's hands and club come up and over his right shoulder and parallel to the intended line of flight of the ball. The apparatus 10 also promotes a significant weight shift to the wearer's right side on the back swing as well as hinging of the wrists and proper hand position at the top of the back swing.

Figure 8:
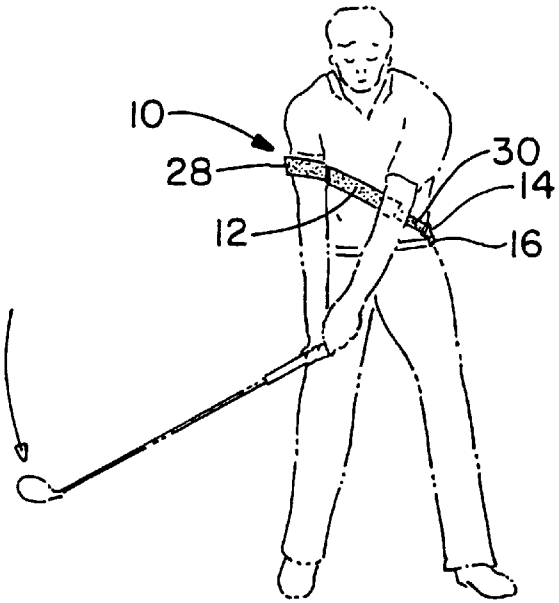
FIG. 8 shows the front view of the apparatus on a golfer at the start of a down swing.

As depicted in FIG. 8, the wearer proceeds from the back swing and begins the down swing of the golf club by turning his shoulders and upper torso to the left, back to his original position. The resiliency of the apparatus 10 will pull against the right arm helping it return to the starting point as the body turns back to the left.

Figure 9:
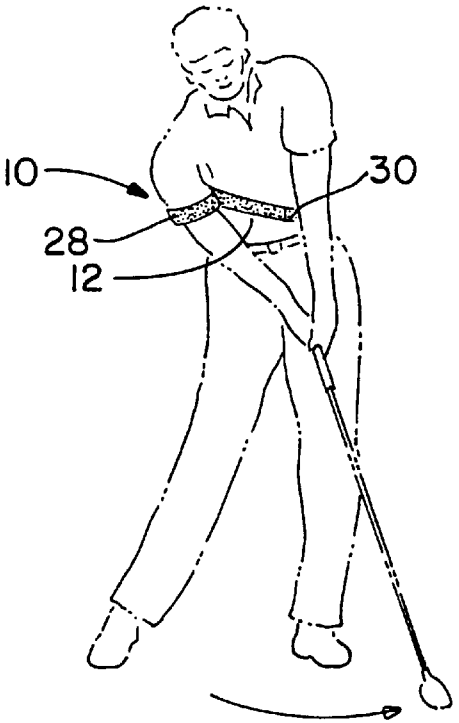
FIG. 9 shows the front view of the apparatus on a golfer just after hitting the ball.

In FIG. 9, the swing continues on its down swing. The resiliency of the apparatus 10 promotes the turn to the left and helps the right shoulder to turn under the chin while the club head returns through its original position and strikes the golf ball. After the ball is struck, the right arm is free to make a natural and unrestricted follow through. The anchoring of the apparatus 10 on the belt over the left hip of the wearer allows for sufficient slack to prevent the resiliency of the apparatus 10 from restricting the follow through motion of the right arm.

While the apparatus 10 will help promote the proper body positioning for a precision swing, the wearer should try to limit the movement of his head and torso up or down and to the front or rear. The apparatus will help the wearer limit such unwanted movement from the wearer's original set-up position. The apparatus 10 is adjustable and works with all body sizes and builds to promote a consistent swing path and plane. The apparatus 10 allows the wearer to discover the feel of a working, classic golf swing. The repeated use of the apparatus 10 will train the wearer to repeat the swing and make a solid hit on the golf ball time after time, even when not wearing the apparatus 10.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. An apparatus for developing a golf swing for a user said apparatus comprising;

a resilient arm band to be worn by a user on a biceps of an arm and having first and second arm band ends and an intermediate arm band portion therebetween;

a slidable buckle fixedly connected to said first arm band end, wherein the intermediate portion of the arm band is slidable through the buckle to define a continuous arm band loop with a diameter that can be adjusted to fit said biceps of the user;

an adjustable strap assembly fixedly connected to said second arm band end;

an anchor attachable to a user; and means for selectively connecting and disconnecting the adjustable strap assembly to the anchor.

2. The apparatus for developing a golf swing of claim 1, wherein the adjustable strap assembly comprises a first inelastic strap having a first end and a second end, a manual adjustment buckle and snap-together clip having an adjustable buckle and male clip portion and a non-adjustable buckle and female clip portion, and a second inelastic strap having a first end and a second end.

3. The apparatus for developing a golf swing of claim 2, wherein the first end of the first inelastic strap is attached to the second arm band end and the second end of the first inelastic strap loops through the adjustable buckle of the adjustable buckle and male clip portion in a manner allowing the length of the adjustable strap assembly to be lengthened or shortened to fit the golfer.

4. The apparatus for developing a golf swing of claim 3, wherein the first end of the second inelastic strap is looped through and non-adjustably attached to the non-adjustable buckle of the non-adjustable buckle and female clip portion and the second end of the second inelastic strap is looped around the means for connecting the adjustable strap assembly to the anchor and slidably secured thereto.

5. The apparatus for developing a golf swing of claim 1, wherein the adjustable strap assembly comprises an inelastic strap having a first end attached to the second arm band end, a second end having a male portion of a hook and loop type fasteners strip attached thereto and an intermediate portion therebetween having a female portion of a hook and loop type fasteners strip of a length considerably longer than the male strip attached to the second end, attached thereto.

6. The apparatus for developing a golf swing of claim 5, wherein the second end of the adjustable strap is looped through the means for connecting the adjustable strap assembly to the anchor and secured to the intermediate adjustable strap portion by contacting the hook and loop type fasteners in a manner that the length of the strap can be adjusted to different lengths to obtain proper tension on the resilient arm band.

7. The apparatus for developing a golf swing of claim 1, wherein the adjustable strap assembly comprises an inelastic strap having a first end and a second end, a manual adjustment buckle, and a spring locking hooked fastener having a buckle-like end.

8. The apparatus for developing a golf swing of claim 7, wherein the second end of the adjustable strap passes through a first end portion of an adjustable strap buckle, then through the buckle-like end portion of the spring locking hooked fastener, and finally through a second end portion of the adjustable strap buckle in a manner allowing the length of the strap to be adjusted to different lengths to obtain proper tension on the resilient arm band.

9. The apparatus for developing a golf swing of claim 8, wherein the spring locking hooked fastener receives the means for connecting the adjustable strap to the anchor.

10. The apparatus for developing a golf swing of claim 1, wherein the adjustable strap assembly is connected to the anchor by an "O" shaped ring.

11. The apparatus for developing a golf swing of claim 10 wherein the "O" shaped ring is made of a metallic material.

12. The apparatus for developing a golf swing of claim 1, wherein the anchor comprises an inelastic strap with a first end attached to a second end by a a metallic snap connector attached thereto, and a locking clip having a buckle portion and a clip jaws portion.

13. The apparatus for developing a golf swing of claim 12, wherein the first end of the inelastic strap loops through the means for connecting the adjustable strap assembly to the anchor and loops through the buckle portion of the locking clip and connectively snaps to the second end of the inelastic strap by means of the metal snap.

14. The apparatus for developing a golf swing of claim 1, wherein the anchor is a metallic band, shaped and constructed in a manner to slip underneath and around the belt of the golfer and to clip onto the means for connecting the adjustable strap to the anchor.

15. The apparatus for developing a golf swing of claim 1, wherein the anchor comprises an inelastic belt attachment strap with a first end, a second end and an intermediate portion therebetween, wherein the first end is attached to the second end by a metallic snap connector attached thereto.

16. The apparatus for developing a golf swing of claim 15, wherein the belt attachment strap is secured to the means for connecting the adjustable strap to the anchor at the intermediate portion of the belt attachment strap and the first end of the belt attachment strap loops around the belt of the wearer behind a belt loop in the wearer's pants and is connected to the second end of the strap by the metallic snap in a manner connecting the belt attachment strap to the belt such that the snap is on the exterior side of the belt enabling the belt attachment strap to be easily secured and removed.

17. The apparatus for developing a golf swing of claim 1, wherein the apparatus is partially comprised of one or more inelastic straps made of a nylon web material.

* * * * *